United States Patent [19]

Brown et al.

[11] 4,077,430

[45] Mar. 7, 1978

[54] STANDPIPE ADAPTER FOR SINK DRAINS OF VARIED DIAMETER

[75] Inventors: Jerome D. Brown, 3237 Par Dr., La Mesa, Calif. 92041; John W. Mansfield, La Mesa, Calif.

[73] Assignee: Jerome D. Brown, La Mesa, Calif.

[21] Appl. No.: 692,979

[22] Filed: Jun. 4, 1976

Related U.S. Application Data

[63] Continuation of Ser. No. 515,585, Oct. 17, 1974, abandoned.

[51] Int. Cl.[2] ..... F17D 1/00

[52] U.S. Cl. ..... 137/593; 137/577; 4/206

[58] Field of Search ..... 137/577, 593; 4/206, 4/255, 256, 257, 286, 287; 251/303; 285/8, 110, 177, 230, 231, 232, 235

[56] References Cited

U.S. PATENT DOCUMENTS

| | | | |
|---|---|---|---|
| 994,442 | 6/1911 | Coles | 4/256 |
| 1,869,049 | 7/1932 | Card | 4/256 |
| 1,894,711 | 1/1933 | Schacht | 4/256 |
| 2,001,230 | 5/1935 | Wayne | 4/256 |
| 2,430,976 | 11/1947 | Dutra | 4/256 |
| 2,928,419 | 3/1960 | Kruse | 137/593 |
| 3,934,280 | 1/1976 | Tancredi | 4/255 |

FOREIGN PATENT DOCUMENTS

| | | | |
|---|---|---|---|
| 161,571 | 10/1957 | Sweden | 251/303 |
| 473,350 | 6/1968 | Switzerland | 285/231 |
| 1,116,951 | 6/1964 | United Kingdom | 285/110 |

*Primary Examiner*—William R. Cline
*Assistant Examiner*—H. Jay Spiegel
*Attorney, Agent, or Firm*—William H. Maxwell

[57] ABSTRACT

An adapter for sink drains of varied diameter, with a double seal positioning a standpipe perpendicularly with respect to the sink bottom, there being an upper seal supportably stopped upon the sink bottom or drain flange, and there being a lower seal depressibly engaged within the drain diameter, and characterized by a base of soft rubber-like material smaller in diameter than the drain and integral with upper and lower seals that have flexible fluid tight engagement with the sink and drain while permitting lateral deflections of the standpipe.

8 Claims, 5 Drawing Figures

FIG. 1.
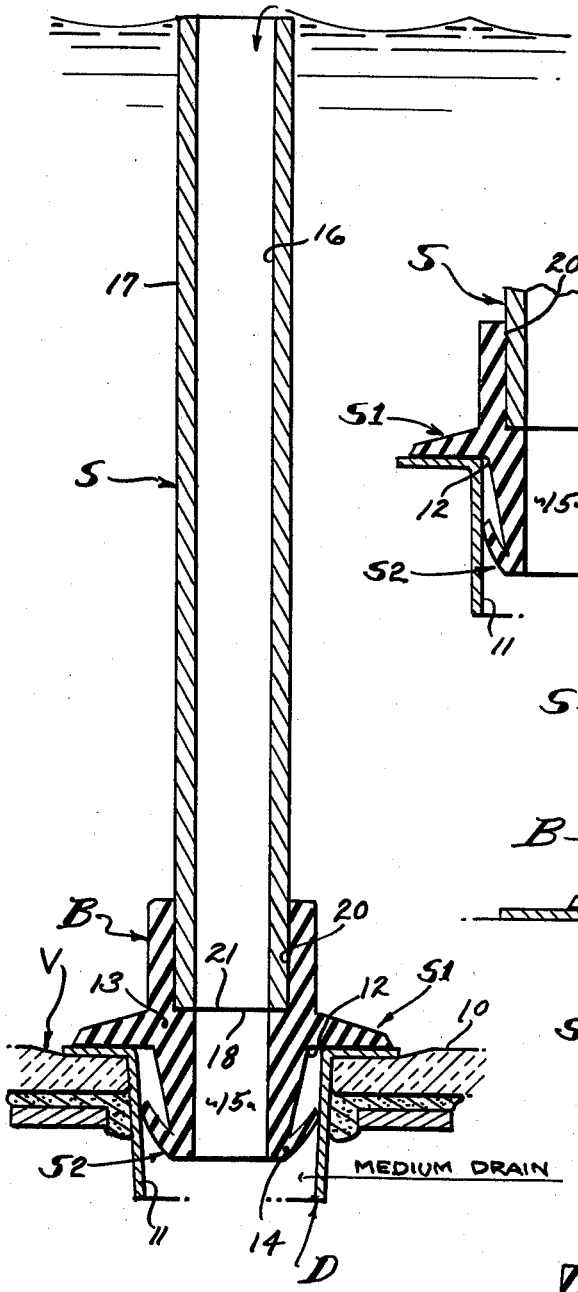
FIG. 2.
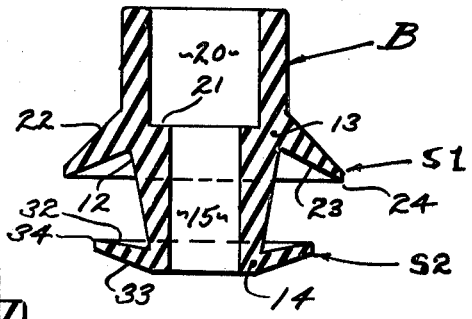
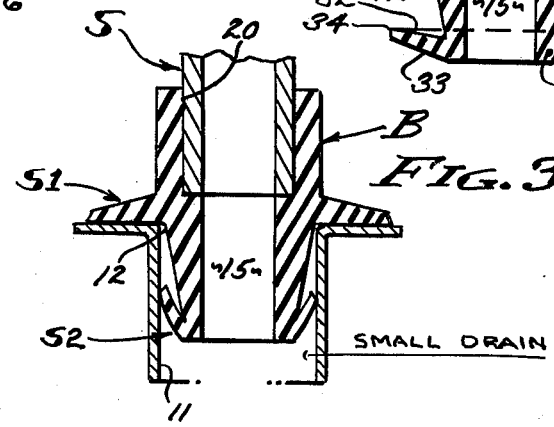
FIG. 3.
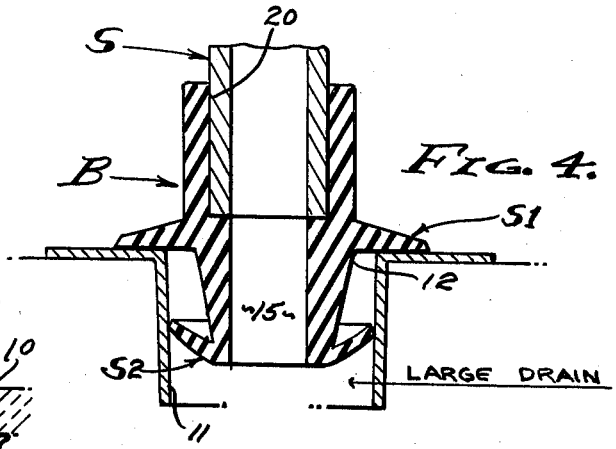
FIG. 4.
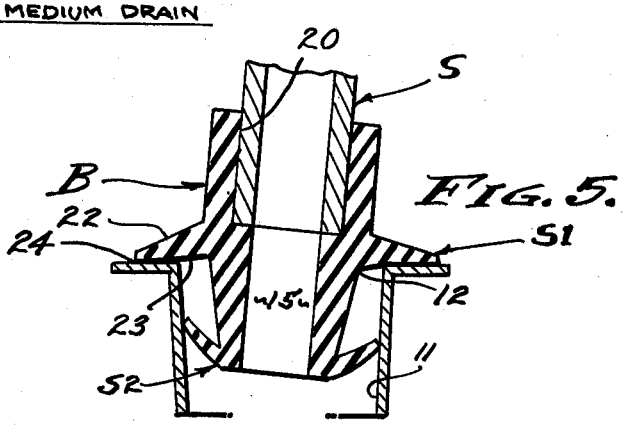
FIG. 5.

STANDPIPE ADAPTER FOR SINK DRAINS OF VARIED DIAMETER

This application is a Continuation of Ser. No. 515,585 filed Oct. 17, 1974 now abandoned. su

BACKGROUND

Sink drains are of varied diameters and are advantageously employed with standpipe attachments, as for example in wash operations at commercial establishments such as restaurants. That is, a level of water is required in a basin or sink, while the water supply thereto remains open and/or displacement of articles immersed therein to cause overflow; a standpipe being a common expedient satisfying this conditioned requirement. However, a standpipe must be in open communication with the sink drain and project perpendicularly from the sink bottom and is vulnerable to abuse. It is a free standing pipe with which this invention is concerned, subject to lateral deflections which heretofore have presented a problem in sealing at the drain connection through the sink bottom. The sealing problem is aggrevated by the variations in size or diameters of such drain openings, which range for example from 1 inch diameter to 1 ⅝ inch diameter. The prior art plugs from which standpipes project have not been too satisfactory, for the reasons that a plug which fits tightly into a small hole fits loosely into a large hole, the seal being effective in the first instance but doubtful in the second instance. It is not the initial static seal which is the real problem, but it is the abuse to which the standpipe is subjected that breaks the seal of a loose plug. Furthermore, the said lateral deflections of a standpipe must be provided for otherwise breakage thereof and of the articles (dishware) can be expected. Therefore, it is a general object of this invention to provide a standpipe adapter which flexibly adapts to drains of varied diameters. The flexibility relates to lateral deflections, while the adaptability relates to a wide range of drain openings with which a sealed connection is maintained even when subjected to angular displacements as caused by said lateral deflections.

Plugs and stoppers from which standpipes have been projected are formed to the opening diameters into which they are fitted, but not so with the present invention wherein the standpipe base is of substantially smaller diameter than the drain opening to which it is connected. Accordingly, it is an object of this invention to provide spaced seals which support the standpipe and permit radial displacement, respectively. With the standpipe adapter herein disclosed, an upper seal is exposed to stop upon the sink bottom for supporting engagement, and a lower seal is expanded to engage circumferentially within the cylindrical drain opening.

Sink plugs are usually made of pliable or rubber-like materials with or without sealing ribs and compressible into the drain opening, thereby establishing fluid tightness; and stoppers have been made with peripheral flanges biased into sealed bottom engagement by the static fluid pressure in the sink. With the present invention it is an object to permit lateral deflection in drain openings of varied diameters, and to this end the adapter base and seals are made of a supple and pliable material, to frictionally receive the standpipe projecting upwardly therefrom, to flexibly engage the sink bottom with its upper seal, and to flexibly engage the drain diameter with its lower seal despite wide variations in drain diameters. The standpipe per se does not penetrate into the base which thereby remains flexible.

SUMMARY OF THE INVENTION

The establishment of a water level in a wash bowl or sink is effectively made by using the standpipe adapter of the present invention which is flexibly adapted to the drain of the sink. A characteristic feature of this standpipe adapter is its adaptability to drains of varied diameter and its capability of being displaced from its normal perpendicular disposition. As shown herein, the standpipe S is an elongated tube that is pressed into a base B from which spaced upper and lower seals S1 and S2 project radially. The tubular sink drain in which the adapter and standpipe is to be installed can vary widely, typical example being shown as a drain D installed in an upwardly open vessel V having bottom 10. The water level therein is established by the height of the open standpipe S which is in open communication with the drain D through the combined base B and seals S1 and S2.

DRAWINGS

The various objects and features of this invention will be fully understood from the following detailed description of the typical preferred form and application thereof, throughout which description reference is made to the accompanying drawings, in which:

FIG. 1 is an elevational sectional view of the standpipe adapter installed in a sink drain of medium diameter.

FIG. 2 is a sectional view of the adapter in its initial form.

FIGS. 3 and 4 are views similar to a portion of FIG. 1 showing the adaptation to sink drains of small and large diameter respectively. And, FIG. 5 is a view of the adapter and standpipe in limited lateral displacement.

PREFERRED EMBODIMENT

The elements B, S1 and S2 which comprise the adapter of the present invention are made as one integral body of material that has elasticity, preferably of rubber or like material. Consequently, the seals S1 and S2 are characteristically supple and flexible in nature, the base B being of substantially heavier cross section than the seals and less subject to distortion. Furthermore, the friction fit of the standpipe S into the base B reinforces the latter; the said integral formation having memory so as to return to its original configuration when external forces are removed. Both normal positioning and extreme lateral displacement of the adapter are illustrated in the drawings.

The base B is a tubular element adapted to be disposed concentrically within the drain cylinder 11 and spaced therefrom. To this end, the major diameter 12 of the base does not exceed the smallest drain diameter into which it is to be fitted (see FIG. 3), and is of a diameter substantially less than the largest drain diameter into which it is to be fitted (see FIG. 4). The base B is formed so as to extend downwardly from the bottom 10 and into the drain cylinder 11, and in accordance with this invention is of truncated conical form with the seal S1 at its uppermost end 13 and with the seal S2 at its lowermost end 14. As shown, the base B is tapered downwardly and inwardly, so as to be of heavy cross section at its uppermost end and lighter cross section at its lowermost end, the taper permitting free lateral displacement of the base while establishing a center of movement at or near the plane of the uppermost end 13 thereof. Both ends 13 and 14 are open, there being a flow passage 15 extending through the base.

The base B is provided with a receptacle 20 to receive the tubular standpipe S which is in the form of an elongated rigid tube of round cross section having inner and outer diameter walls 16 and 17 and flat terminal ends 18 normal to its central axis. Accordingly, the receptacle 20 is an enlarged counterbore entering into the top of the base, and preferably into a sleevelike boss that extends above the plane of the sink bottom 10. As shown, the inside diameter 16 of standpipe S corresponds substantially in diameter to that of the passage 15, there being a shoulder 21 provided thereby and upon which the standpipe S is seated. The standpipe reinforces the receiver boss which it enters, the depending portion of the base being more or less flexible dependent upon the pliability and/or elasticity of the material employed.

The uppermost seal S1 is adapted to hydrostatically support any head of water contained in the open vessel V as determined by the height of the standpipe S. Since it is known that the drain will always have a peripheral flange that is reasonably smooth and in a normal plane continuation of the bottom 10, the seal S1 is a downwardly flared flange with upper and lower walls 22 and 23 convergent to a peripheral lip 24 disposed in a normal plane to the central axis of the base and adapted to engage flatly upon the drain flange, or alternately upon the bottom 10. The seal S1 is essentially cone-shaped and is deformed to the plane of the drain flange or bottom 10 as and when hydraulic pressure is applied (see FIGS. 1 and 3–5). However, angular displacement will lift one side of the seal S1 without disengagement of lip 24 from the drain flange or bottom (see FIG. 5).

The lowermost seal S2 is adapted to hydrostatically support the leakage of any water through the aforementioned seal S1, as may be due to abuse and/or any excessive lateral displacement or deflection thereof. Since it is known what range of diameters within which this seal is to be fitted, the diameter of drain cylinder 11, the seal S2 is of a formed diameter to peripherally engage the largest cylinder 11 while being deflected to a substantial extent (see FIG. 4). To this end, the seal S2 is an upwardly flared flange with spaced upper and lower walls 32 and 33, preferably convergent to a peripheral lip 34 disposed in a normal plane spaced substantially below the aforementioned plane of bottom 10 and adapted to engage circumferentially within the cylinder 11. The seal S2 is essentially cone-shape and is deformed to yieldingly fit cylinder 11 by forcing the base B into the drain, thereby biasing the flange of the seal by deflecting the same so as to cause the base to be centered in the drain but subject to forcible angular displacement.

From the foregoing, it will be seen that the adapter herein disclosed is simple and practical, it is adaptable to a wide range of drain diameters, and it is capable of lateral deflection without breaking the double seals. Both seals are hydrostatic and operable to support any head of water likely to be imposed thereupon, and in the event of extreme abuse to cause leakage by the upper seal, the lower seal is effective to preclude leakage by means of the tapered formation of the base acting to limit the angular displacement thereof which carries the lowermost seal and to the end that its peripheral engagement with the cylinder 11 of the drain is assured and not broken.

Having described only a typical preferred form and application of our invention, we do not wish to be limited or restricted to the specific details herein set forth, but wish to reserve to ourselves any modifications or variations that may appear to those skilled in the art:

We claim:

1. An adapter for sealed engagement of a radially movable standpipe with sink bottom drains of varied diameter cylinder opening disposed on fixed vertical axes, and including; a conical and downwardly tapered tubular base element of rubber-like material with a top at least smaller and a bottom substantially smaller in diameter than the cylinder opening of the drain into which it is inserted and with a flow passage opening therethrough, an upwardly open receptacle in a boss integral with and projecting upwardly from the top of the base to move therewith and in open communication with the flow passage, a tubular standpipe received in the receptacle and with a passage continuation of the base passage, an uppermost seal comprised of a flexible peripheral flange integral with and projecting radially from the top of the base element to overlie and supportably engage upon a surrounding area of the sink bottom, and a lowermost seal comprised of a flexible and radially depressible peripheral flange integral with and projecting radially from the bottom of the base element and having continuous circumferential engagement within the cylinder opening when axially aligned with the said cylinder opening and also when axially misaligned therewith and thereby permitting lateral radial movement of the standpipe relative to the sink bottom drain without breaking sealed engagement.

2. The standpipe adapter as set forth in claim 1 wherein the uppermost seal is a downwardly flared flange axially depressible for hydrostatic engagement upon said area of the sink bottom.

3. The standpipe adapter as set forth in claim 1 wherein the uppermost seal is a downwardly flared flange with a fexible peripheral lip axially depressible for hydrostatic engagement upon said area of the sink bottom.

4. The standpipe adapter as set forth in claim 1 wherein the lowermost seal is upwardly cupped and radially expansible for hydrostatic engagement within the cylinder opening of the sink drain.

5. The standpipe adapter as set forth in claim 1 wherein the lowermost seal is an upwardly flared flange radially expansible for hydrostatic engagement within the cylinder opening of the sink drain.

6. The standpipe adapter as set forth in claim 1 wherein the lowermost seal is an upwardly flared flange with a flexible peripheral lip radially expansible for hydrostatic engagement within the cylinder opening of the sink drain.

7. The standpipe adapter as set forth in claim 1 wherein the uppermost seal is a downwardly flared flange axially depressible for hydrostatic engagement upon said area of the sink bottom, and wherein the lowermost seal is an upwardly flared flange radially expansible for hydrostatic engagement within the cylinder opening of the sink drain.

8. The standpipe adapter as set forth in claim 1 wherein the uppermost seal is a downwardly flared flange with a flexible peripheral lip axially depressible for hydrostatic engagement upon said area of the sink bottom, and wherein the lowermost seal is an upwardly flared flange with a flexible peripheral lip radially expansible for hydrostatic engagement within the cylinder opening of the sink drain.

* * * * *